US007410115B2

(12) United States Patent
Sugioka et al.

(10) Patent No.: US 7,410,115 B2
(45) Date of Patent: Aug. 12, 2008

(54) REVOLVING TYPE YARN WINDING MACHINE

(75) Inventors: Takami Sugioka, Matsuyama (JP); Seiji Yoshioka, Matsuyama (JP); Noriki Ishimaru, Matsuyama (JP); Norihide Akiyama, Matsuyama (JP); Masachiyo Fukuishi, Matsuyama (JP)

(73) Assignee: TSTM Co., Ltd., Matsuyama-shi (JP)

( * ) Notice: Subject to any disclaimer, the term of this patent is extended or adjusted under 35 U.S.C. 154(b) by 56 days.

(21) Appl. No.: 10/522,890

(22) PCT Filed: Feb. 5, 2003

(86) PCT No.: PCT/JP03/01180

§ 371 (c)(1),
(2), (4) Date: Jun. 7, 2005

(87) PCT Pub. No.: WO2004/018340

PCT Pub. Date: Mar. 4, 2004

(65) Prior Publication Data

US 2006/0054732 A1 Mar. 16, 2006

(30) Foreign Application Priority Data

Aug. 20, 2002 (JP) ..... 2002-239860

(51) Int. Cl.
*B65H 67/048* (2006.01)

(52) U.S. Cl. ..... 242/474.6

(58) Field of Classification Search ..... 242/473.8, 242/474.3, 474.4, 474.5, 474.6, 474.8, 474.9, 242/475, 481.7, 530.1, 530.4
See application file for complete search history.

(56) References Cited

U.S. PATENT DOCUMENTS

| | | | | |
|---|---|---|---|---|
| 4,136,834 | A * | 1/1979 | Tschentscher | 242/476.1 |
| 4,505,437 | A * | 3/1985 | Schippers et al. | 242/481.7 |
| 5,779,170 | A * | 7/1998 | Siepmann et al. | 242/127 |
| 6,015,113 | A | 1/2000 | Daly et al. | |
| 6,158,689 | A | 12/2000 | Mayer et al. | |

FOREIGN PATENT DOCUMENTS

| | | |
|---|---|---|
| JP | 01-267270 | 10/1989 |
| JP | 08-301522 | 11/1996 |
| JP | 11-116139 | 4/1999 |
| JP | 2000-327228 | 11/2000 |
| JP | 2002-515388 A | 5/2002 |

* cited by examiner

*Primary Examiner*—Peter M. Cuomo
*Assistant Examiner*—William E Dondero
(74) *Attorney, Agent, or Firm*—Rothwell, Figg, Ernst & Manbeck

(57) ABSTRACT

A multi-end revolving type automatic winding machine exhibiting high operationality, threading operability and space efficiency, and arranged such that two turret tables (3, 3') are disposed on the opposite sides of a yarn passage, rotational directions of a press roller (9) provided for one turret table (3) and a press roller (9') provided for the other turret table (3') are reversed, rotational directions of one turret table (3) and the other turret table (3') are reversed, and the center of each press roller (9, 9') touching a bobbin holder or a yarn being wound during winding of yarn is located between an imaginary line c connecting the centers of two bobbin holders (4, 5) projecting from one turret table (3') and an imaginary line c' connecting the centers of two bobbin holders (4', 5') projecting from the other turret table (3').

12 Claims, 8 Drawing Sheets

REVOLVING TYPE YARN WINDING MACHINE

CROSS REFERENCE TO RELATED APPLICATION

This application is a 35 U.S.C. § 371 National Phase Entry Application from PCT/JP03/01180, filed Feb. 5,2003, and designating the U.S.

TECHNICAL FIELD

The present invention relates to a revolving type automatic yarn winding machine. More specifically, the present invention relates to a revolving type automatic yarn winding machine which comprises a turret table rotatably mounted on a unit case, the turret table having a plurality of bobbin holders, for inserting yarn winding bobbins thereon, rotatably mounted thereon, and wherein yarn winding operation is switched to a bobbin installed on the other bobbin holder when the yarn wound on one bobbin holder reaches a predetermined amount.

BACKGROUND ART

When a yarn spun from spinnerets of a spinning machine is continuously wound on a bobbin, a revolving type winding machine is generally used, which machine comprises a turret table rotatably mounted on a unit case, two bobbin holders rotatably mounted on the turret table for inserting yarn winding bobbins thereonto, a movable frame movable in a vertical direction, a press roller rotatably mounted on the movable frame, and a traverse device disposed upstream the press roller seen along a yarn passage.

For example, in such a conventional yarn winding machine, as illustrated in FIG. 12, two winding machines are adjacently disposed, and yarns separated from the upstream feed rollers are fed to the two winding machines.

As another prior art, Japanese Patent Application Laid-open No. Hei 1-267270 discloses a winding machine wherein a plurality of turret tables are vertically arranged on one machine frame.

Further, as another prior art, Japanese Patent Application Laid-open No. 2002-515388 discloses a winding machine wherein two turret tables are vertically arranged on one machine frame, and thus constructed units are symmetrically arrange in a horizontal direction.

In yarn winding machines, in recent years, there is a tendency to apply multi-ends, i.e., insertion of a plurality of bobbins onto one spindle, in order to increase production and application of multi-ends has been done by combining winding machines. In this case, it is required to increase the space efficiency per production, to reduce the equipment cost, to increase threading operability, and to enhance the prettiness of the shape of wound packages.

In order to meet with the requirements, in the conventional machine illustrated in FIG. 12, since two winding machines are disposed in parallel, the distance between yarns entering into the two winding machines becomes large, and accordingly, the angle $\alpha$ formed between two yarns leaving the feed rollers, increases. As a result, there are problems that the contacting angle between a yarn and a yarn guide G becomes large, that the frictional resistance increases, and that fluffs occur in the yarn.

If the contacting angle between a yarn and a yarn guide G is made small as a countermeasure for such problems, the positions of the feed rollers are lifted, and there occurs a problem that operationality is degraded.

In a winding machine disclosed in Japanese Patent Application Laid-open No. Hei 1-267270, the turret tables are vertically arranged, and therefore, the height of the machine becomes high and the operationality is remarkably degraded.

Further, in a conventional winding machine disclosed in Japanese Patent Application Laid-open No. 2002-515388, upon first threading operation, a plurality of yarns which are being sucked into a suction device are threaded through fulcrum guide of traverse motion onto bobbins inserted onto bobbin holders which are in contact with press rollers disposed downstream the traverse devices and are rotated, and accordingly, there is the following problem.

The winding machines are arranged vertically and symmetrically in a horizontal direction. Accordingly, upon threading operation, in order to avoid interference between yarns and the winding machines, it is necessary to perform threading operation onto every winding machines from one located at the upper stage or lower stage one by one while a plurality of yarns are being sucked. As a result, time needed for threading operation becomes long, the amount of waste yarn increases, and efficiency is reduced.

When yarns are threaded onto the horizontally disposed winding machines, since the press rollers and the bobbin holders are in contact while they are arranged horizontally, it is necessary for the yarns to be widely deflected upon threading operation, and success ratio for threading is reduced.

Further, since the press rollers are horizontally retracted as the amount of wound yarn increase, the width of a winding machine becomes large, and space efficiency is remarkably reduced.

Taking the drawbacks inherent to the prior art into consideration, it is an object of the present invention to provide a multi-end revolving type automatic yarn winding machine which exhibits high operationality, high threading operability and good space efficiency.

DISCLOSURE OF THE INVENTION

According to the present invention, the above-described object is achieved by a revolving type winding machine comprising two turret tables having at least two bobbin holders rotatably mounted thereon, respectively, a press roller and a traverse device are arranged corresponding to the bobbin holders upstream the respective turret table, whereby a bobbin installed on one bobbin holder is switched to a bobbin installed on the other bobbin holder when the yarn wound on the bobbin reaches a predetermined amount characterized in that the two turret tables are disposed on the opposite sides of a yarn passage, rotational directions of a press roller provided for one turret table and a press roller provided for the other turret table are reversed, rotational directions of the one turret table and the other turret table are reversed, and the center of each press roller touching a bobbin holder or a yarn being wound during winding of yarn is located between an imaginary line c connecting the centers of two bobbin holders projecting from the one turret table and an imaginary line c' connecting the centers of two bobbin holders projecting from the other turret table.

In this case, it is preferred that an imaginary line connecting the center of the press roller and the rotating center of the bobbin holder forms an angle $\beta$ which is not larger than 45° relative to a vertical line.

Further, it is preferred that the imaginary lines c and c' connecting the centers of the respective two bobbin holders form "/\" shape at least upon start of yarn winding.

Furthermore, it is preferred that a threading device is disposed correspondingly to each bobbin holder located at winding position, the threading device is provided with a threading guide, and during storage, the threading guide is located at a storing position which is sandwiched by loci a and a' drawn by outer surfaces of bobbins inserted onto the bobbin holders projecting from the turret tables upon rotation of the turret tables, while upon threading, a plurality of threading guides are movable in such directions that they move away from each other from the storing position to threading position which exceeds contacting lines b and b' between the press rollers and outer surfaces of rotating bobbins which are contacting with the press rollers.

The press rollers may be movable so that distance between the centers of the press rollers and the bobbin holders are expanded as the amount of yarn wound on bobbins inserted onto the bobbin holders increase.

The turret tables having the bobbin holders projecting therefrom may be movable so that distance between the centers of the bobbin holders and the press rollers are expanded as the amount of yarn wound on bobbins inserted onto the bobbin holders increase.

The press rollers may be linearly movable, it may be rotatably supported at an end of an arm 31 or 31', and the other end 32, 32' of the arm 31 or 31' may be pivoted.

Further, when symmetric winding machines 1 and 1' are disposed, and threading and switching signals are simultaneously sent and the present invention is applied, the object and unexpected advantages of the present invention can be obtained.

BRIEF DESCRIPTION OF THE DRAWINGS

The present invention will now be explained with reference to the attached drawing wherein embodiments of the present invention are illustrated, wherein.

BEST MODE FOR CARRYING OUT THE INVENTION

Figure 1:
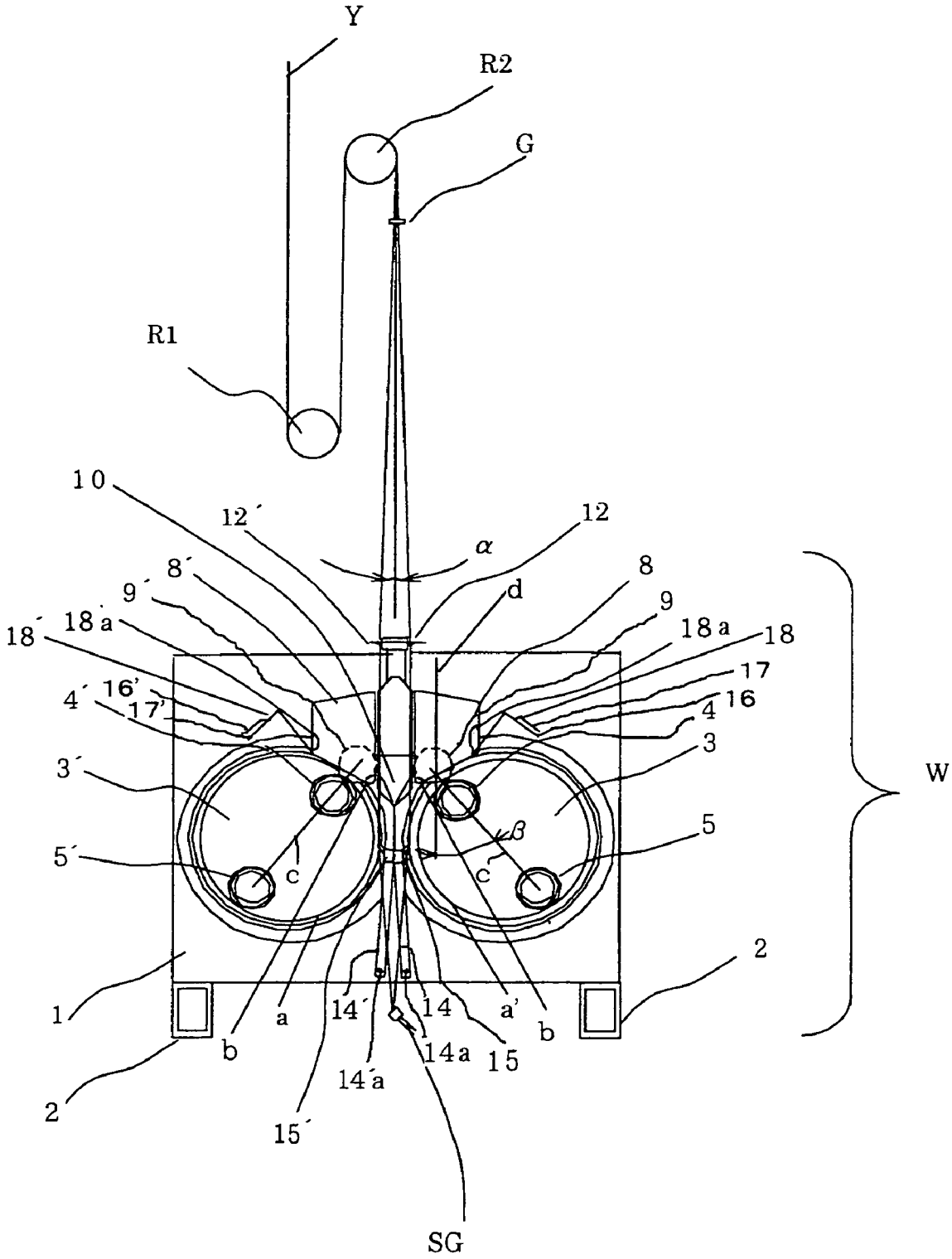
FIG. 1 is an elevation of an embodiment of a revolving type automatic yarn winding machine according to the present invention.
Figure 2:
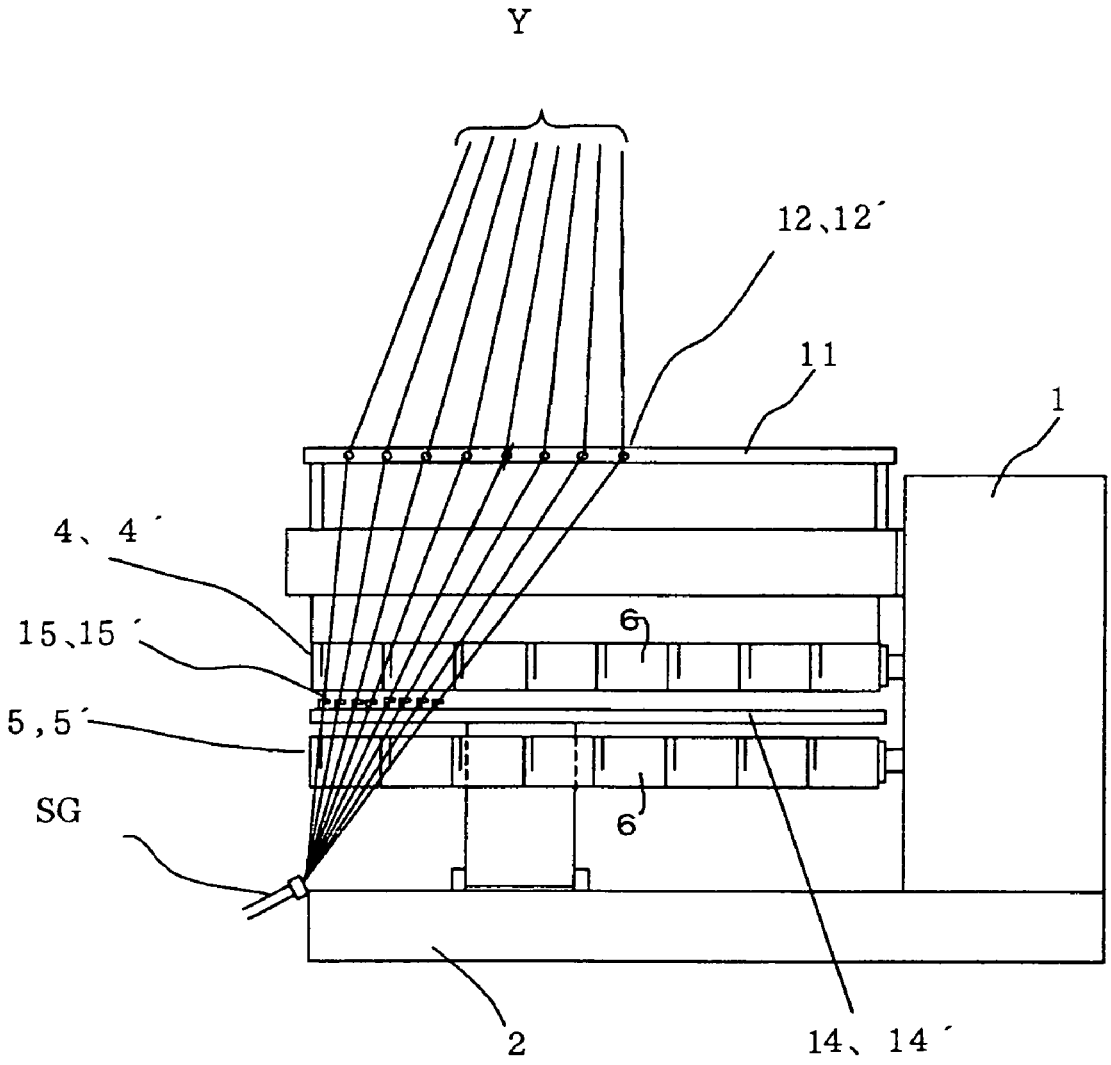
FIG. 2 is a side view of the embodiment upon initial threading operation.

In FIGS. 1 and 2, a plurality of (eight in the present embodiment) yarns Y continuously fed from spinnerets (not shown) of a spinning machine are wrapped around feed rollers R1 and R2. A yarn guide G for separating a plurality of yarns Y at a predetermined distance is disposed at the exit of the feed roller R2.

Fulcrum guides 12 and 12' of traverse motion are disposed downstream the feed roller R2, so that passages of a plurality of yarns Y are regulated by means of the fulcrum guides 12 and 12' of traverse motion at a distance between the wound packages. The fulcrum guides 12 and 12' of traverse motion are movable in an axial direction along a device 11 for moving the fulcrum guides 12 and 12' of traverse motion, which device is horizontally disposed downstream the feed roller R2.

The body of a unit case 1 of a winding machine W is of a rectangular parallelpiped and has a base 2 extending to the operational space near the front end, i.e., the left side in FIG. 2, disposed at the bottom thereof. The unit case 1 has circular disc shaped turret tables 3 and 3' disposed at the front thereof and mounted rotatable about central axes extending into a horizontal direction, and they are rotated in opposite directions, i.e., turret table 3 is rotated clockwise and the turret tables 3' is rotated counter-clockwise, by means of driving means such as motors (not shown).

The turret tables 3 and 3' have two bobbin holders 4, 5 and 4',5', respectively, rotatably mounted thereon in a direction perpendicular to the sheet on which FIG. 1 is drawn, i.e., in the sheet direction of FIG. 2. The bobbin holders 4, 5 and 4',5' are connected to driving means (not shown), respectively, and two bobbin holders 4 and 5 are rotated clockwise and the other two bobbin holders 4' and 5' are rotated counter-clockwise at a predetermined speed. Eight bobbins 6 may be inserted onto the bobbin holders 4, 5 and 4',5', respectively, of this embodiment.

Although in the present embodiment, spindle drive type winding machine wherein bobbin holders are directly driven is explained, the present invention may be carried out in a friction drive type winding machine wherein a press roller is driven by means of an electric motor and the press roller is brought into contact with a bobbin holder so as to drive.

The unit case 1 has two slide rails (not shown) vertically disposed inside thereof, a vertically movable frame 8 is moved in a vertical direction along the slide rails by means of a fluid pressure cylinder (not shown).

The vertically movable frame 8 has press rollers 9 and 9', which contact with the bobbins 6 inserted onto the bobbin holders 4, 5, 4' and 5' or yarn layers formed on the bobbins 6, and a traverse device 10 mounted thereon, which device traverses the yarns Y in axial direction of the bobbin 6. The press rollers 9 and 9' are supported on the vertically movable frame 8 in such a manner that at least one is swingable independently relative to the vertically movable frame 8.

The press rollers 9 and 9' are in contact with the surfaces of the packages intending that the press roller 9 and 9' feed yarns Y to the bobbins 6 and press the yarns so that the prettiness of the shape of the wound packages is enhanced and that the hardness of the wound packages is increased when the yarns Y are wound onto the bobbins 6 inserted onto the bobbin holders 4, 5, 4' and 5'.

In this embodiment, one traverse device 10 is disposed between the two press roller 9 and 9'. The traverse device 10 is provided with a cylindrical cam (not shown) which is driven by a drive means (not shown), and traverse guides engaging with the groove of the cam traverse the yarns Y to and fro in a direction of axis of the bobbins 6 within the traverse range.

Though the traverse device 10 of a traverse cam type is used in the embodiment, a traverse device, such as a traverse device of a rotary blade type, may be used.

According to the present invention, the center of the press rollers 9 and 9' touching bobbin holders 4, 5, 4', and 5' are so constructed that they are located between an imaginary line c connecting the centers of two bobbin holders 4 and 5 projecting from one turret table 3 and an imaginary line c' connecting the centers of two bobbin holders 4' and 5' projecting from the other turret table 3'.

According to the present invention, the two turret tables are disposed on the opposite sides of a yarn passage, rotational directions of a press roller provided for one turret table and a press roller provided for the other turret table are reversed, and rotational directions of one turret table and the other turret table are reversed. Accordingly, the width of a winding machine can be small, and space efficiency increases.

Further, upon start of yarn switching operation, in other words, upon start of rotation of the turret table, since the turret table is accelerated, there is a tendency that the bobbin holder is lifted by the acceleration. In order to overcome this tendency, in the present invention, the press roller 9 and 9' are located in a specific geometrical relationship with the turret tables 3 and 3', more specifically, the centers of the press rollers 9 and 9' touching bobbin holders 4, 5, 4', and 5' are so constructed that they are located between an imaginary line c connecting the centers of two bobbin holders 4 and 5 projecting from one turret table 3 and an imaginary line c' connecting the centers of two bobbin holders 4' and 5' projecting from the other turret table 3'. According to this geometrical construction, the bobbin holder is prevented from lifting the press roller due to the acceleration at the start of rotation of the turret tables 3 and 3', and the bobbin holders can rotate smoothly, and the inward movement of the outer yarn layer of package upon start of rotation of the turret tables and yarn package damage due to excessive contacting pressure can be prevented from occurring, and there is an unexpected advantage that the quality of yarn can be enhanced.

Figure 8:
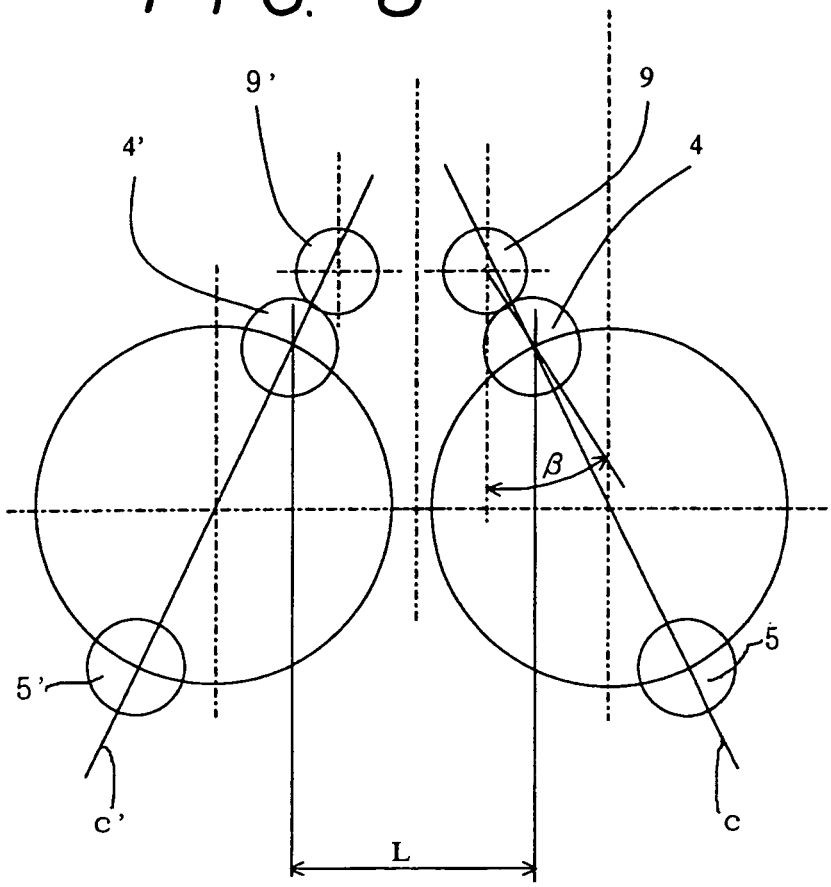
FIG. 8 is a graph showing the positional relationship between a bobbin holder and a press roller.

Further, in addition to the above-described geometrical construction, when an imaginary line connecting the rotating center of the press roller 9 or 9' and the rotating center of the bobbin holders 4 or 5 forms an angle β which is not larger than 45° relative to a vertical line d, the moving direction of the press roller 9 or 9' can be almost vertical. Accordingly, the width of a winding machine can be small, and space efficiency increases. (See FIG. 8.)

Furthermore, it is so constructed that the imaginary lines c and c' connecting the centers of the respective two bobbin holders 4, 5 and 4', 5' form "/\" shape at least upon start of yarn winding. More specifically, the distance between the bobbin holders 4 and 4' with empty bobbins is set smaller than the distance L wherein they have fully wound packages thereon, and at the same time, it is set larger than the distance wherein the full packages just after switching operation do not interfere with each other, and thus, the width of the winding machine can be small.

In addition, as described above, the device 11 for moving the fulcrum guides is disposed almost horizontally and in parallel with the bobbin holders at a position above the traverse device, and device 11 for moving the fulcrum guides is provided with a plurality of fulcrum guides 12 and 12' corresponding to the bobbins 6 and 6' inserted onto the bobbin holders 4, 5, 4' and 5'.

The fulcrum guides 12 and 12' are so constructed that they are movable in an axial direction along the bobbin holders 4, 5, 4' and 5'. Thus, the fulcrum guides 12 and 12' are fixed at positions corresponding to the longitudinal centers of the packages wound onto bobbins 6 inserted onto the bobbin holders 4, 5, 4' and 5', during winding operation, while they are moved to the front side of the bobbin holders, i.e., near the operating space, when the yarns are threaded onto the bobbins.

Further, the unit case 1 has the lower ends 14*a* and 14'*a* of the threading devices 14 and 14' pivoted at the lower central portion thereof, and the threading devices 14 and 14' are pivotal about the lower ends 14*a* and 14'*a* and are moved between the returning position (FIG. 1) located below the central portion of the unit case 1 and the operating position upon initial threading (FIG. 4) by means of a cylinder (not shown).

Figure 4:
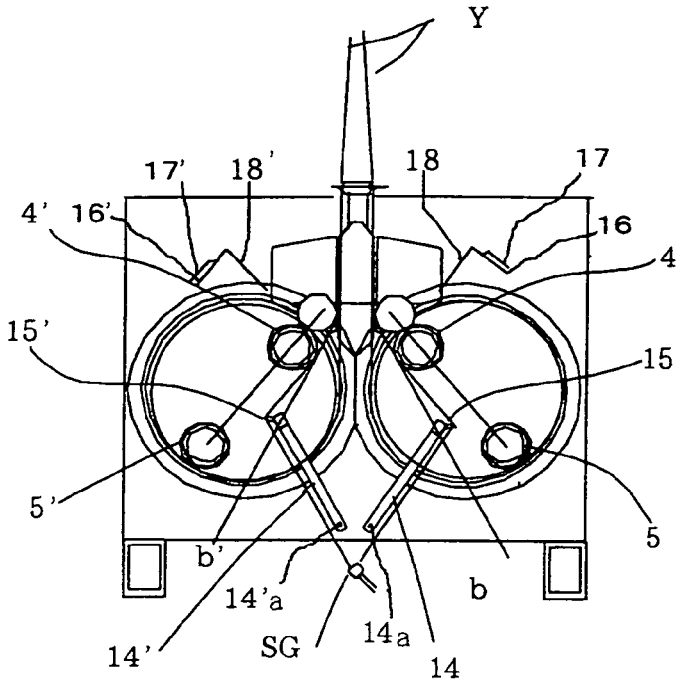
FIG. 4 is an elevation of the embodiment upon initial threading operation.

More specifically, the threading device 14 or 14' is so disposed that it corresponds to the respective bobbin holder 4 or 5 located at the winding position, and the threading device 14 or 14' is provided with an initial threading guides 15 or 15' at an end opposite to the lower end. During storage, the threading devices 14 and 14 are stored at the storing position (FIG. 1), and during threading operation, they are movable from the storing position to the threading position (FIG. 4). The storing position is located at a position sandwiched by loci a and a' drawn by outer surfaces of bobbins inserted onto the bobbin holders projecting from the turret tables upon rotation of the turret tables 3 and 3'. Contrary to this, the threading position is located at a position which exceeds contacting lines b and b' between the press rollers 9 and 9' and outer surfaces of rotating bobbins 6 which are contacting with the press rollers 9 and 9', and at the threading position, a plurality of threading guides 15 and 15' are movable in such directions that they move away from each other.

The threading device 14 and 14' extend in a direction in parallel with the sheet on which FIG. 2 is drawn and in parallel with the bobbin holders 4, 5, 4' and 5' from the front surface of the unit case 1 to a position near the operating space, and the initial threading guides 15 and 15' are movable along the threading device 14 and 14' by means of a fluid cylinder (not shown).

Further, the unit case 1 has ends 18*a* and 18'*a* of L-cross sectioned plates 18 and 18' pivoted at the upper central portion thereof, and the plates 18 and 18' are pivotal about the ends 18*a* and 18'*a*. The plates 18 and 18' are provided with yarn guides 16 and 16' which guide yarns to yarn catching grooves of the bobbins 6 and yarn passage limiting guides 17 and 17' which limit the yarn passage so that the yarns Y do not drop from the end surfaces of the wound packages of a predetermined amount.

The initial threading operation and the switching operation of the fully wound package in this embodied machine will now be explained.

<Initial Threading Operation>

Below the spinnerets of the spinning machine, while the yarn Y are being sucked by a suction device SG, they are threaded onto the feed rollers R1 and R2 and the yarn guide G.

Then, as illustrated in FIG. 2, the fulcrum guides 12 and 12' of traverse motion equipped with the device 11 for moving the fulcrum guides are moved to the positions where the yarns are threaded from positions corresponding to the longitudinally central portion of the bobbins, and the yarns are threaded into the fulcrum guides 12 and 12'.

Then, after the bobbins 6 and 6' inserted onto the bobbin holders 4 and 4' are brought in contact with the press rollers 9 and 9', the initial threading guides 15 and 15' are moved to the initial threading positions illustrated in FIG. 2. Then, after the yarns Y are threaded into the initial threading guides 15 and 15', the suction device SG is positioned at the lower portion of the operating space of the winding machine as illustrated in FIGS. 2 to 4.

Figure 3:
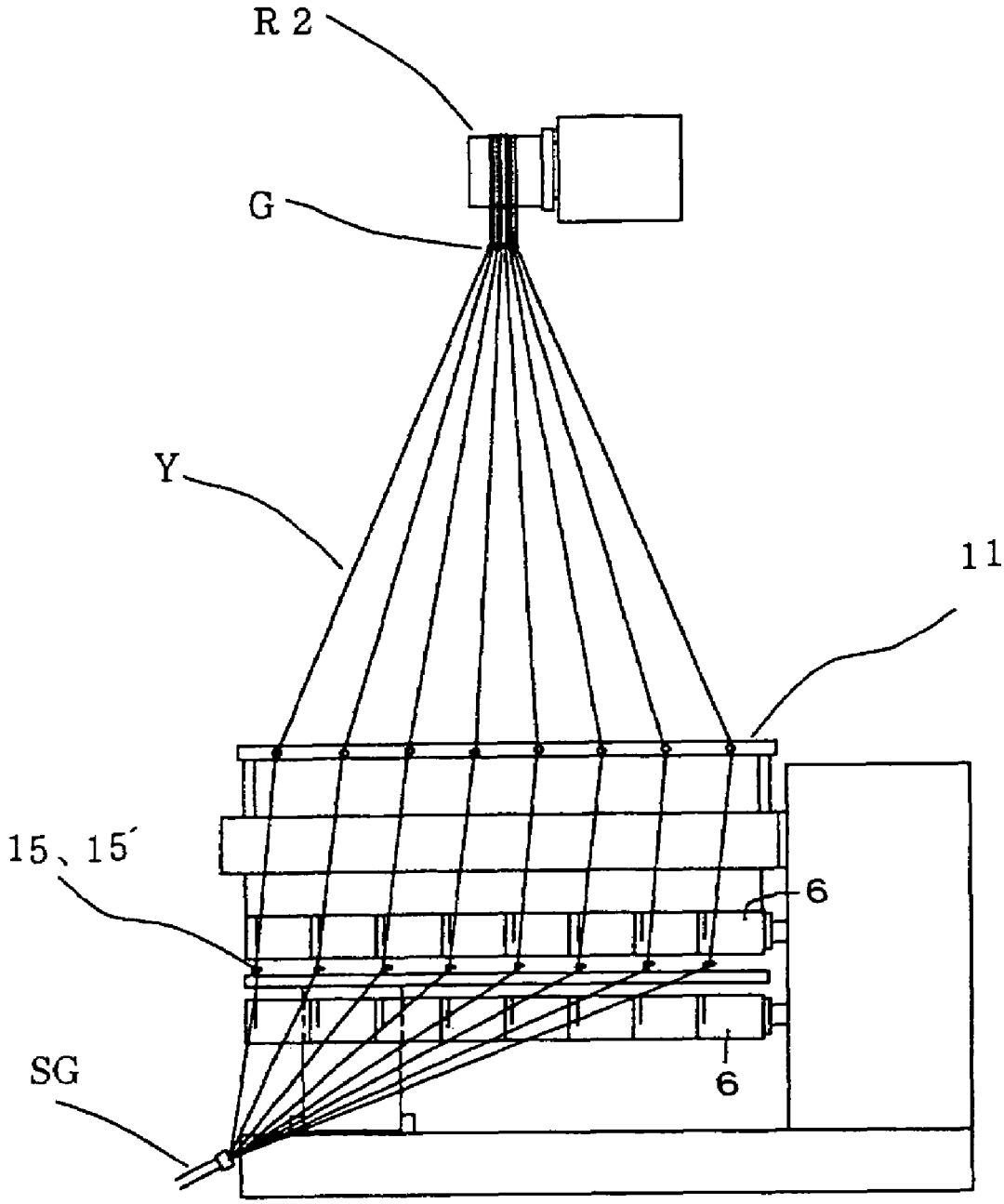
FIG. 3 is a side view of the embodiment showing operation at the initial threading operation subsequent to the condition illustrated in FIG. 2.

FIG. 3 shows the condition just before the start of initial threading operation, wherein the rotations of the bobbin holders 4 and 4' and the press rollers 9 and 9' have been started and have reached the predetermined rotating speed. As illustrated in FIG. 3, the initial threading guides 15 and 15' are moved to positions corresponding to the yarn catching grooves formed on the bobbins 6 inserted onto the bobbin holders 4 and 4' by means of a fluid cylinder (not shown).

Then, the threading devices 14 and 14' are swung by means of the cylinder (not shown) to the condition illustrated in FIG. 4. More specifically, the threading devices 14 and 14' are swung by means of the cylinder (not shown) to positions exceeding the imaginary lines b and b' connecting the outer surfaces of the press rollers 9 and 9' and the outer surfaces of the bobbins 6 and 6', and the yarns deflecting at the initial threading guides 15 and 15' are engaged with the yarn catching grooves formed on the bobbins 6 and 6', and winding of the yarns onto the bobbins 6 and 6' is started.

Then, the threading devices 14 and 14' are returned to positions outside the area defined by loci a and a' drawn by the outer surfaces of bobbins inserted onto the bobbin holders so as to prevent the outer surfaces of the bobbins inserted onto the bobbin holders from contacting with the threading device 14 and 14'.

<Winding Operation>

The operation from the start of winding to the completion of winding in this embodied machine will now be explained.

The bobbin holder 4 is rotated clockwise while the bobbin holder 4' is rotated counter-clockwise, and the yarns are wound onto bobbins 6 inserted onto the bobbin holders 4 and 4'.

According to the present invention, the distance L between the centers of the bobbin holders 4 and 4' at the winding start position is smaller than the outer diameter of fully wound package. Accordingly, if the yarns are wound until completion of winding while the bobbin holders are kept at the winding start position, the full packages on the bobbin holder 4 and the full packages on the bobbin holder 4' interfere with each other.

In order to obviate this problem, according to the present invention, both the winding packages are moved away from each other as the winding amount increases so that the wound packages keep a predetermined distance therebetween. More specifically, at the start of yarn winding, the yarns are wound onto bobbins inserted onto the bobbin holders 4 and 4' while the turret tables 3 and 3' are fixed at positions, and the press rollers 9 and 9' are lifted together with the vertically movable frame 8.

When the diameter of the wound package reaches a predetermined amount, the turret tables 3 and 3' are moved in such direction that the distances between the press rollers 9 and 9' and the bobbin holders 4 and 4' increase. More specifically, after the vertically movable frame 8 lifts to a predetermined height, the yarns are wound onto bobbins inserted onto the bobbin holders 4 and 4' while the turret table 3 is rotating clockwise at low speed and the turret table 3' is rotating counter-clockwise at low speed.

<Switching Operation of Fully Wound Bobbin>

The switching operation of fully wound packages in this embodied machine will now be explained.

When the amount of yarn wound as described above reaches a predetermined amount, while the turret table 3 is rotated clockwise at high speed and the turret table 3' is rotated counter-clockwise at high speed, the yarn guides 16 and 16' and the yarn passage limiting guides 17 and 17' enter between the bobbin holder 4 and the bobbin holder 5 and between the bobbin holder 4' and the bobbin holder 5', respectively, as will be described later so that the yarns are engaged with the yarn catching grooves formed on the bobbins 6 inserted onto the bobbin holders and are cut by means of catching force of the yarn catching grooves, and then, yarns 6 are wound onto the bobbins 6 inserted onto the bobbin holders 5 and 5'.

Figure 5:
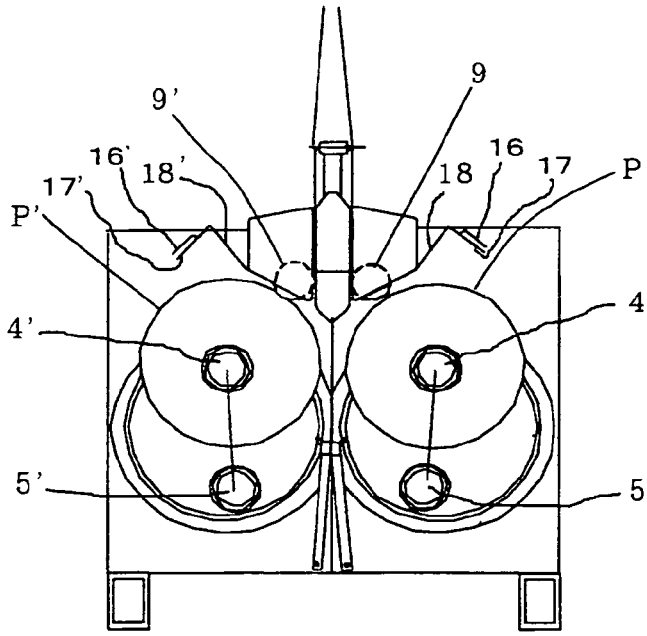
FIG. 5 is a view showing the condition wherein yarns are being wound onto bobbins inserted onto bobbin holders in the embodiment.

The operation, especially those of the yarn guides 16 and 16' and the yarn passage limiting guides 17 and 17', will now be explained with reference to FIG. 5. FIG. 5 shows the condition just before effecting yarn switching after the amounts of yarn wound onto bobbins 6 inserted onto the bobbin holders 4 and 4' reach a predetermined amount.

Under this condition, the front ends of the plate 18 and 18' are lifted by means of a fluid cylinder (not shown), and the yarn guides 16 and 16 and the yarn passage limiting guides 17 and 17' are positioned at the returning positions so that they so not interfere with yarns.

Figure 6:
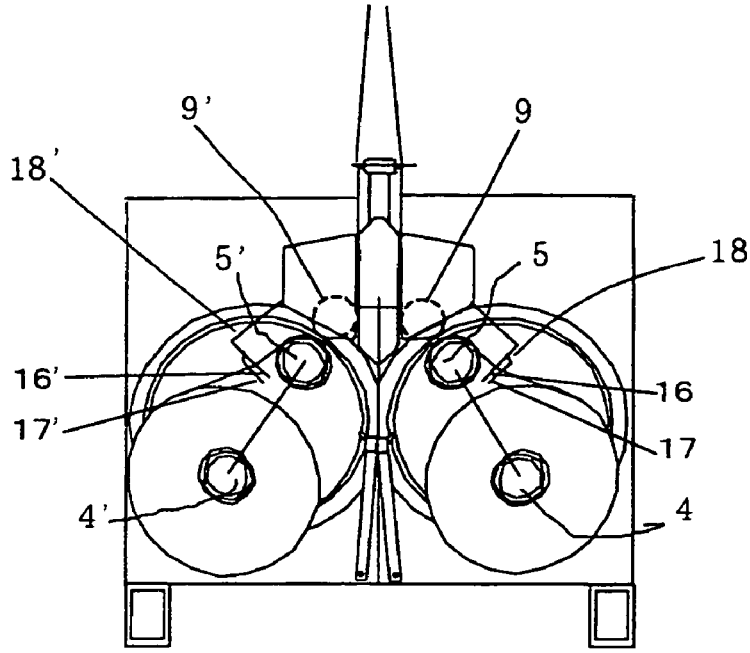
FIG. 6 is an elevation showing the yarn switching condition.

By means of a drive device (not shown), the turret table 3 is rotated clockwise and the turret table 3' is rotated counter-clockwise so that they are brought into a condition illustrated in FIG. 6. In this condition, the front ends of the plate 18 and 18' are lowered (see FIG. 6) by means of a fluid cylinder (not shown), and the yarn guides 16 and 16' and the yarn passage limiting guides 17 and 17' begin to move from the returning positions to the operating position.

Figure 7:
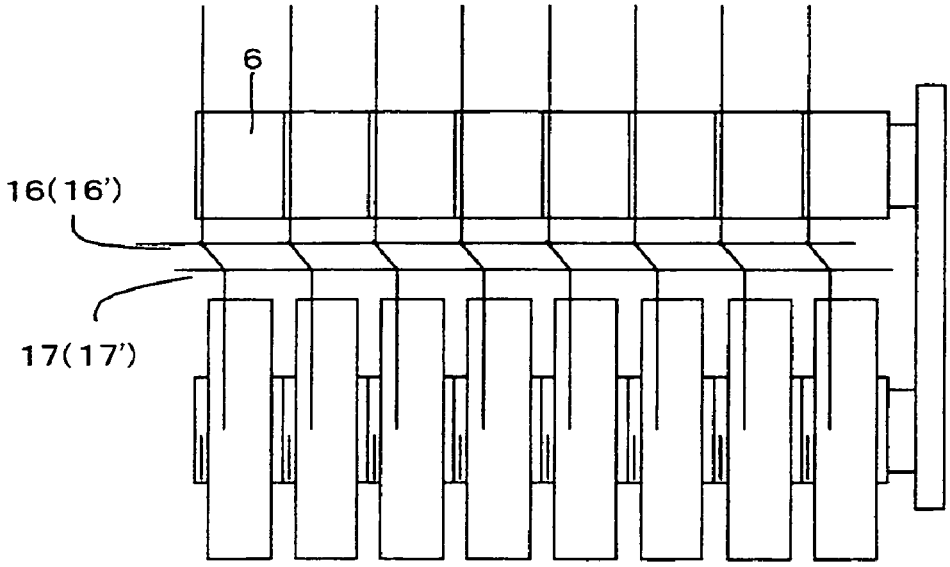
FIG. 7 is a side view seen in a direction perpendicular to bobbin holder upon switching.

Then, as illustrated in FIG. 7, while the yarn wound on yarn package of a predetermined amount is being prevented from dropping from wall end of the package by means of the yarn passage limiting guides 17 or 17', the yarn guides 16 or 16' are moved to the left in FIG. 7 so that the yarn is engaged with yarn catching groove of empty bobbin 6.

The full packages wound on the bobbins 6 inserted onto the bobbin holders 4 and 4' are exhausted to the outside by means of a doffing device (not shown) after the rotation of the bobbin holders 4 and 4' stops.

The plate 18 and 18', the yarn guides 16 and 16', and the yarn passage limiting guides 17 and 17' are returned from their operating positions to their returning positions after a predetermined operations, such as the threading onto the empty bobbins 6 inserted onto the bobbin holders 5 and 5', the exhaust of fully wound packages wound onto bobbins 6 inserted onto the bobbin holders 4 and 4', and the donning of empty bobbins onto the bobbin holders 4 and 4', are completed.

As described above, since the two press rollers 9 and 9' are supported on one vertically movable frame 8, and since they are so constructed that at least one of the rollers 9 and 9' is independently movable relative to the vertically movable frame 8, the difference in diameters of the packages wound on both the bobbin holders can be regulated.

Further, the threading device is disposed at the center of the two turret tables 3 and 3', and after the yarn wound on the bobbin holder disposed on one turret table and the yarn wound on the bobbin holder disposed on the other turret table are succeedingly guided to the yarn guide, the threading device is operated so that both the yarns are simultaneously threaded, and accordingly, threading time can be shortened.

Figure 9:
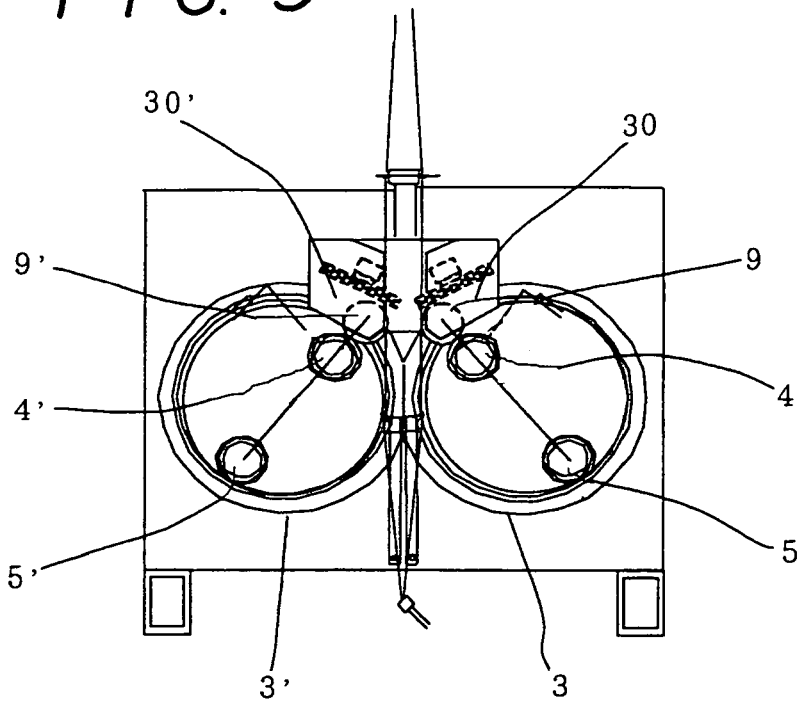
FIGS. 9, 10 and 11 are elevations showing other embodiments of the present invention.
Figure 10:
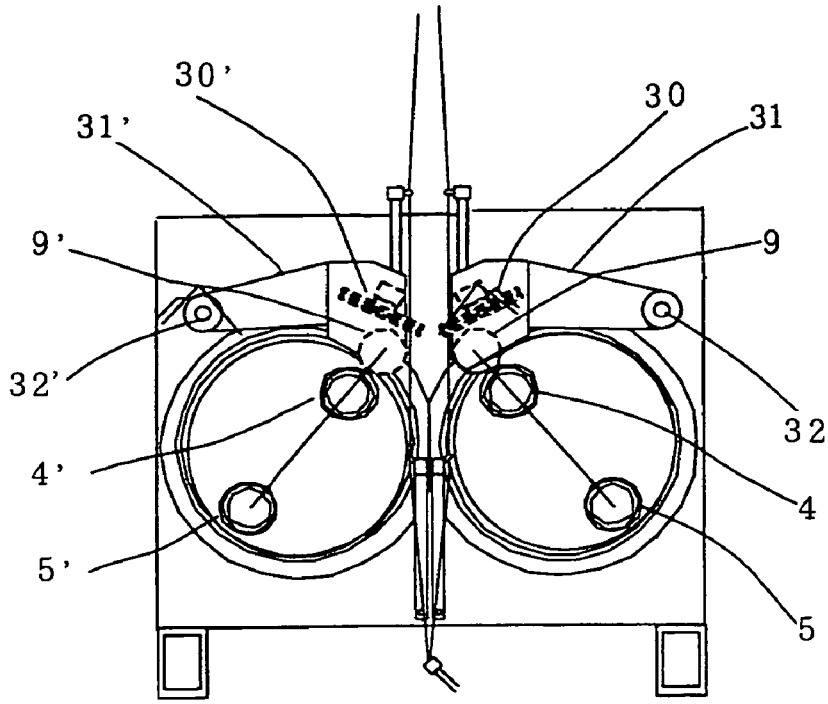
Figure 11:
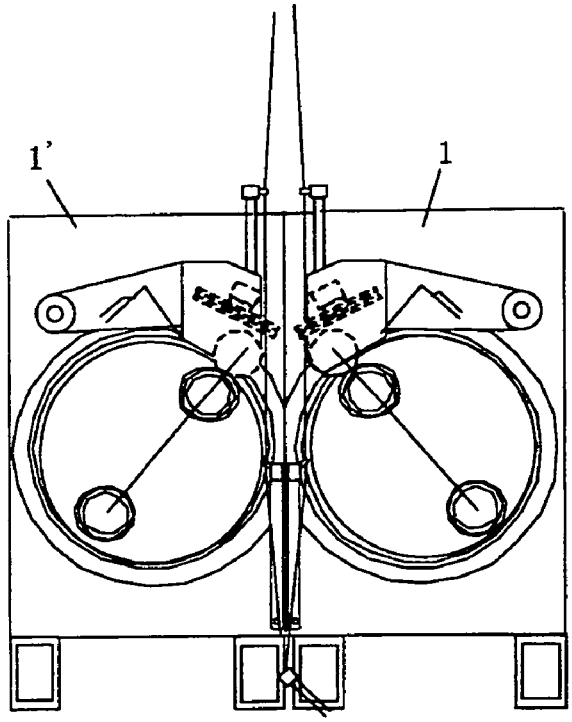
Figure 12:
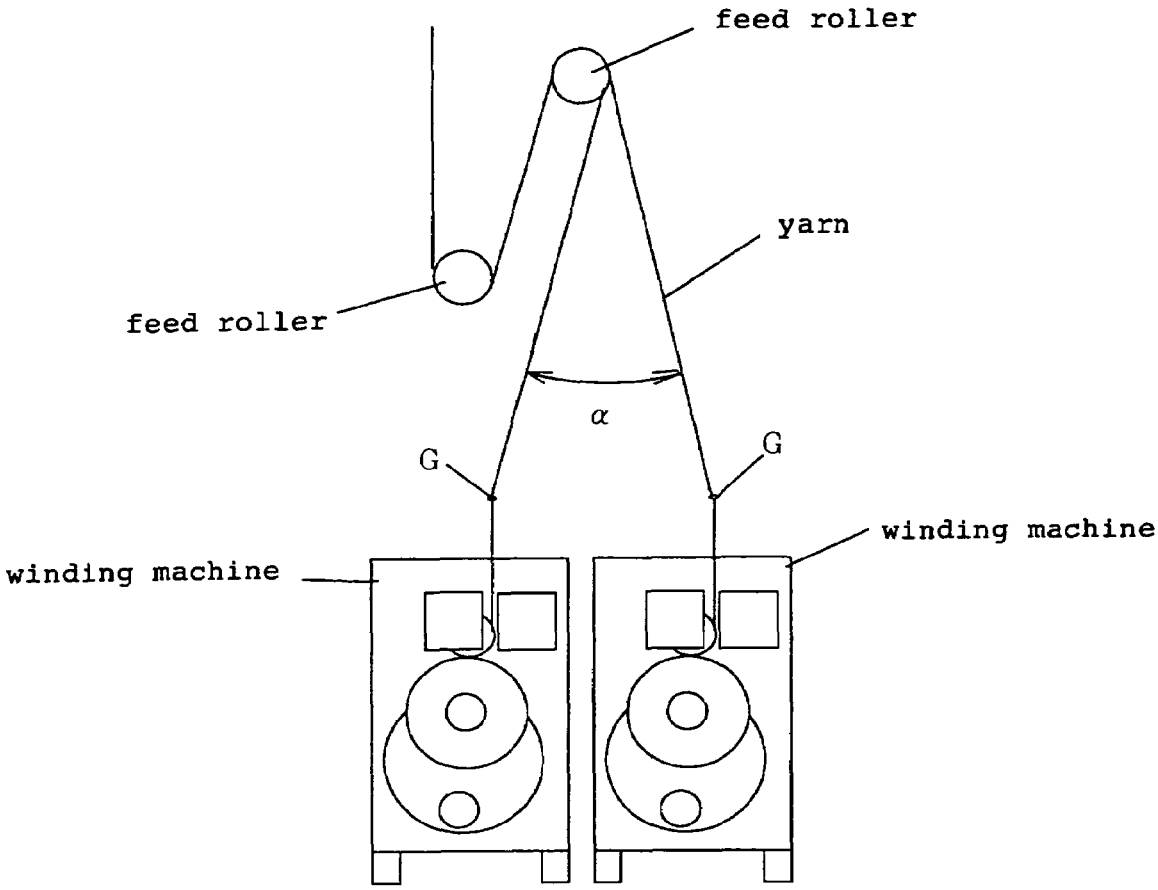
FIG. 12 is an elevation of a certain conventional device.

Although in the yarn winding machine shown in the embodiment, a traverse device is disposed between two press rollers, as illustrated in FIGS. 9 to 11, traverse devices 30 and 30' for traversing yarns may be so disposed upstream the two press rollers that they correspond to the press rollers, respectively.

The traverse device may be a so called rotary blade traverse device, wherein a plurality of rotary blades are rotated in opposite directions.

The present invention provides a revolving type winding machine comprising two turret tables having at least two bobbin holders rotatably mounted thereon, respectively, a press roller and a traverse device are arranged corresponding to the bobbin holders upstream the respective turret table, whereby a bobbin installed on one bobbin holder is switched to a bobbin installed on the other bobbin holder when the yarn wound on the bobbin reaches a predetermined amount characterized in that the two turret tables are disposed on the opposite sides of a yarn passage, rotational directions of a press roller provided for one turret table and a press roller provided for the other turret table are reversed, rotational directions of the one turret table and the other turret table are reversed, and the center of each press roller touching a bobbin holder or a yarn being wound during winding of yarn is located between an imaginary line c connecting the centers of two bobbin holders projecting from the one turret table and an imaginary line c' connecting the centers of two bobbin holders projecting from the other turret table. Accordingly, the width of a winding machine can be small, and space efficiency increases.

Further, upon start of yarn switching operation, in other words, upon start of rotation of the turret table, the bobbin holder is prevented from lifting the press roller due to the acceleration at the start of rotation of the turret tables, and the bobbin holders can rotate smoothly, and the inward movement of the outer yarn layer of package upon start of rotation of the turret tables even at high turret speed and yarn package damage due to excessive contacting pressure can be prevented from occurring, and there is an unexpected advantage that the quality of yarn can be enhanced.

Further, in addition to the above-described geometrical construction, when an imaginary line connecting the rotating center of the press roller 9 or 9' and the rotating center of the bobbin holders 4 or 5 forms an angle β which is not larger than 45° relative to a vertical line d, the moving direction of the press roller 9 or 9' can be almost vertical. Therefore, the width of a winding machine can be small, and space efficiency increases. Accordingly, increase of space efficiency per production and reduction of equipment cost can be achieved.

Further, it is preferred that the imaginary lines c and c' connecting the centers of the two bobbin holders 4 and 5, and 4' and 5', respectively, form "/\" shape at least upon start of yarn winding. More specifically, the distance between the empty bobbins 4 and 4' inserted onto the bobbin holders 4, 5, 4' and 5' is set smaller than the distance having fully wound package, and at the same time, it is set larger than the distance wherein the fully wound packages just after switching operation do not interfere with each other, and thus, the width of the winding machine can be small.

Further, according to the present invention, the angle α formed between two yarns leaving the feed rollers and entering the winding machine can be not larger than 20°, and accordingly, deflection of yarns can be small and the quality of yarns increases.

The invention claimed is:

1. A revolving winding machine comprising two turret tables having at least two bobbin holders rotatably mounted thereon, respectively, a press roller and a traverse device are positioned above a horizontal plane in which axes of said two turret tables lie, whereby a bobbin installed on one bobbin holder is switched to a bobbin installed on the other bobbin holder when the yarn wound on the bobbin reaches a predetermined amount characterized in that said two turret tables are disposed on the opposite sides of a yarn passage, rotational directions of a press roller provided for one turret table and a press roller provided for the other turret table are reversed, rotational directions of said one turret table and the other turret table are reversed, and the center of each press roller touching a bobbin holder or a yarn being wound during winding of yarn is located between an imaginary line c passing through the centers of two bobbin holders projecting from said one turret table and an imaginary line c' passing through the centers of two bobbin holders projecting from the other turret table, wherein when said revolving winding machine is in use, yarn encircles less than 180 degrees of said press rollers.

2. A revolving winding machine according to claim 1 characterized in that an imaginary line connecting the center of said press roller and the rotating center of said bobbin holder form angle β which is not larger than 45° relative to a vertical line.

3. A revolving winding machine according to claim 1 characterized in that said imaginary lines c and c' passing through the centers of the respective two bobbin holders form "/\" shape at least upon start of yarn winding.

4. A revolving winding machine according to claim 1 characterized in that a threading device is disposed correspondingly to each of said at least two bobbin holders located at winding position, said threading device is provided with a threading guide, and during storage, said threading guide is located at a storing position which is sandwiched by loci a and a' drawn by outer surfaces of bobbins inserted onto said at least two bobbin holders projecting from said turret tables upon rotation of the turret tables, while upon threading, a plurality of threading guides are movable in such directions that they move away from each other from said storing position to threading position which exceeds contacting lines b and b' between said press roller and outer surfaces of rotating bobbins which are contacting with said press rollers.

5. A revolving winding machine according to claim 1 characterized in that said traverse device for traversing yarns is disposed between at least two of said two press rollers.

6. A revolving winding machine according to claim 1 characterized in that at least two of said traverse devices, corresponding respectively to at least two of said press rollers, for traversing a yarn is disposed upstream of said two press rollers, wherein said two traverse devices have a plurality of rotating blades, rotating in an opposite direction, so as to traverse a yarn.

7. A revolving winding machine according to claim 1 characterized in that said press rollers are movable so that distance between the centers of said press rollers and said at least two bobbin holders are expanded as the amount of yarn wound on bobbins inserted onto said bobbin holders increase.

8. A revolving winding machine according to claim 7 characterized in that said press rollers are linearly movable.

9. A revolving winding machine according to claim 7 characterized in that said press rollers are rotatably supported at an end of an arm, and the other end of the arm is pivoted.

10. A revolving winding machine according to claim 1 characterized in that said turret tables having said at least two bobbin holders projecting therefrom are movable so that distance between the centers of said at least two bobbin holders and said press rollers are expanded as the amount of yarn wound on bobbins inserted onto said at least two bobbin holders increase.

11. A revolving winding machine according to claim 1 characterized in that a feed roller is disposed upstream from said two turret tables.

12. A revolving winding machine according to claim 1 characterized in that said imaginary lines c and c' passing through the centers of the respective two bobbin holders form an acute angle at their intersect at least upon start of yarn winding.

* * * * *